United States Patent [19]

Egan

[11] Patent Number: 4,904,124

[45] Date of Patent: Feb. 27, 1990

[54] CONSTRUCTIONAL WORK AND METHOD OF CONSTRUCTION OF VERTICAL RETAINING WALL

[75] Inventor: Philip D. Egan, Great Falls, Va.

[73] Assignee: The Reinforced Earth Company, Arlington, Va.

[21] Appl. No.: 365,974

[22] Filed: Jun. 14, 1989

[51] Int. Cl.[4] ..... E02D 5/00

[52] U.S. Cl. ..... 405/262; 405/258; 405/284

[58] Field of Search ..... 405/258, 262, 284–287, 405/272, 282

[56] References Cited

U.S. PATENT DOCUMENTS

| | | | |
|---|---|---|---|
| 4,329,089 | 5/1982 | Hilfiker et al. | 405/287 X |
| 4,343,571 | 8/1982 | Price | 405/284 |
| 4,391,557 | 7/1983 | Hilfiker et al. | 405/287 |
| 4,524,551 | 6/1985 | Scheiwiller | 405/286 X |
| 4,530,622 | 7/1985 | Mercer | 405/258 |
| 4,818,150 | 4/1989 | Jaecklin | 405/258 X |

*Primary Examiner*—Dennis L. Taylor

*Attorney, Agent, or Firm*—Allegretti & Witcoff, Ltd.

[57] ABSTRACT

An improved earthen construction is comprised of horizontal layers of reinforcing elements or tensile members with a fabric over a part of the elements and with a U-shaped cross section basket filled with granular material defining the forward or face of the wall. The U-shaped basket is especially dimensioned and constructed of generally rigid tensile members to ensure the integrity of the wall. Flexible fabric lines the basket and also extends over the basket. Backfill material coacts with the elements by at least partial frictional engagement to provide a soil reinforced structure.

19 Claims, 2 Drawing Sheets

CONSTRUCTIONAL WORK AND METHOD OF CONSTRUCTION OF VERTICAL RETAINING WALL

BACKGROUND OF THE INVENTION

This invention relates to an improved constructional work and a method of construction for such a constructional work.

In U.S. Pat. No. 3,421,326 Vidal discloses a constructional work in which tensile elements are arranged in horizontal layers in a compacted earthen mass. The elements fictionally engage the particulate earthen material and thereby provide a cohesive structure. Vidal discloses further constructional works of a similar nature in U.S. Pat. No. 3,570,252 as well as U.S. Pat. Nos. 3,570,253, 3,686,873, and 3,981,038. The various earthen work constructions utilize a mosaic of wall panels or other materials to form a vertical or generally upwardly extending wall in combination with tensile members projecting into an earthen mass.

Vidal teaches that various types of reinforcing or tensile materials can be used in combination with a compacted mass of particular material. For example, strips of metal such as galvanized steel can be utilized. Additionally, a wire grid or plastic materials can be used. Vidal further teaches that various types of wall panel constructions can be utilized in combination with the many types of soil reinforcing elements. For example, the front face or wall of a soil reinforced structure can be comprised of solid, pre-cast panel members. Alternatively, gabions filled with particulate can be used. Additionally various grid facings such as wire grid facings can be used. All of this was taught or suggested by Vidal in his various patents.

In addition, others have suggested specific constructions for tensile elements and facing materials including Hilfilker in U.S. Pat. Nos. 4,260,296, 4,266,890, 4,154,554, 4,505,621 and 4,117,686.

Such soil reinforced earthen works have now become a recognized civil engineering structure. It is a category of structure useful in the retention of hillsides and in building retaining walls as well as right of way embankments and the like.

There has remained, however, a need for improved soil reinforced constructions and methods of building soil reinforced constructions which are even more economic than those previously developed. Such needs, in part, inspired the development of the present invention.

SUMMARY OF THE INVENTION

Briefly the present invention is an improved constructional work which includes a soil reinforcing grid or pattern of tensile members or elements arranged in a generally horizontal array on a compact of soil or earth. The grid extends from a line defining a generally upward front face of wall of the constructional work. Overlying at least a portion of the grid is a flexible fabric material which also extends vertically upward along the face of the wall. Behind the fabric material is a basket fabricated from generally rigid tensile members. The basket includes a front wall, a back wall, and a connecting bottom wall. The bottom wall is positioned over the flexible fabric and re-enforcing grid adjacent the front face of the constructional work. The basket is filled with granular material which is compacted and retains the basket in position. The front wall of the basket coincides generally with the front face of the constructional work. The flexible fabric fits over the top of the filled basket. Backfill particulate material is provided over the grid and against the back wall of the basket. The backfill material also receives the flexible fabric. Multiple layers of this general construction may be arranged one on top of the other to define a soil reinforced constructional work.

Construction of the novel structure is comprised of the sequential steps of (1) positioning reinforcing grid members or elements on a horizontal surface, (2) then positioning the flexible fabric over the grid members, (3) followed by positioning the basket on the fabric and grid members along the wall line. (4) Next, the basket is filled with granular backfill and the flexible fabric is folded over the basket. Backfill is then placed over the grid members on the back wall side of the basket and is compacted.

Numerous variations of the basic construction and method are possible. The size of the basket is such that the bottom wall dimension of the basket extending from the wall face may be a lesser dimension than the vertical or height dimension for the front wall of the basket. Further, struts may be used to connect the front wall and back wall of the basket to preserve the structural integrity of the basket. Both the basket and the grid members may be fabricated from wire rod or plastic or other materials. Preferably plastic or other synthetic materials can be used.

As an object of the invention, the construction and method of the invention provides an improved, economical soil reinforced structure.

A further object of the invention is to provide a soil reinforced structure comprised of inexpensive materials which can use native soils as backfill.

Yet another object of the invention is to provide an improved soil reinforced structure which requires a minimum of component parts and which is easy to assemble because the parts are light weight and easily maneuverable.

Yet a further object of the invention is to provide an improved soil reinforced construction and method which utilizes, in an effective manner, synthetic materials such as plastic materials.

Yet another object of the invention is to provide an improved soil reinforced construction and method wherein the various components of the construction, at least in part, frictionally engage with particulate material.

These and other objects advantages and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

The constructional work of the invention is generally comprised of four basic parts including: (1) reinforcing elements or members defining an array or a reinforcing grid arranged generally horizontally within a particulate; (2) flexible fabric which fits over the reinforcing members and also over the face of the constructional work; (3) a basket of generally rigid material having a generally U-shaped cross section and with one side defining the front face of the wall; and (4) granular backfill material retained in the basket as well as over the grid and fabric. This assemblage of component parts is arranged in an array of horizontal layers one on top of the other to define the constructional work. The following description thus relates to a description of certain component parts and to the assemblage of those parts to define the constructional work.

The Formed Basket

Figure 1:
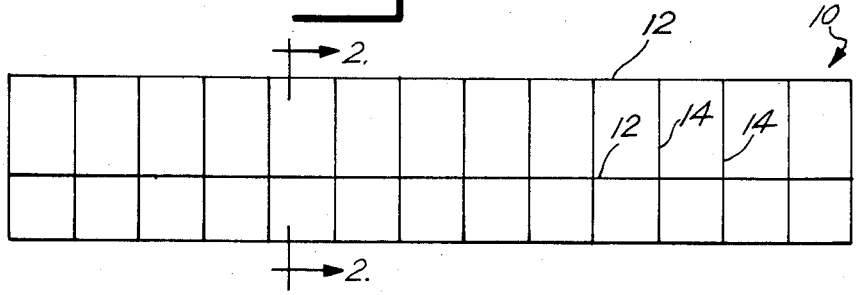
FIG. 1 is a front elevation of a basket construction associated with a first embodiment of the invention.
Figure 2:
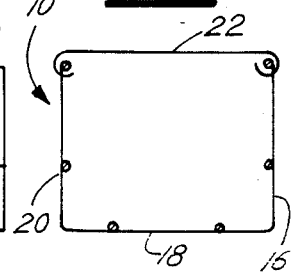
FIG. 2 is a side cross sectional view taken along line 2—2 in FIG. 1 illustrating the construction of the basket associated with the first embodiment of the invention.

FIGS. 1 and 2 illustrate a first embodiment of a basket 10 which is used to define the front face of the constructional work. The basket 10 is typically made from a grid work of rigid rods such as steel rods which are welded together and then shaped to define the basket 10 having a U-shaped cross section as shown in FIG. 2. Alternatively the basket 10 can be molded from a plastic material for example.

As depicted in FIGS. 1 and 2, basket 10 is comprised of generally horizontal rod members 12 which extend along the width of the basket and generally transverse rod members 14 connecting the members 12. In the embodiment shown, the rod members 12 and 14 thus define a lattice work. This lattice work is generally rigid and has a cross sectional shape as depicted in FIG. 2 which is generally U-shaped. As also shown in FIG. 2, basket 10 is defined by a front wall 16, a bottom wall 18, and a rear or back wall 20. The walls 16 and 20 are of generally uniform or equal height. The walls 16 and 20 are connected to each other along their top edges by longitudinal struts 22. Three to four struts 22 typically connect the top longitudinal rods 12 associated with the front wall 16 and back wall 20.

Typically the depth of the basket 10, i.e., distance between walls 16 and 20 is slightly greater than the height of the walls 16 and 20. The spacing of various elements or rods comprising the basket 10; namely, the elements 12 and 14, may be varied in accord with strength requirements to contain the contents thereof. Typical dimensions of the opening defined by the rods 12 and 14 is 6 inches by 8 inches. A typical dimension associated with the bottom 18 as shown in FIG. 2 is 20 inches and the typical height associated with the front wall 16 is approximately 15 inches. A typical width of the basket 10 as shown in FIG. 1 is approximately 72 to 80 inches. Of course, all of these dimensions may be varied in accord with empirical testing or calculations involving the strength of the materials involved, the size of particulate, and the dimensions of the constructional work.

The Other Component Parts and Method of Assembly

Figure 3:
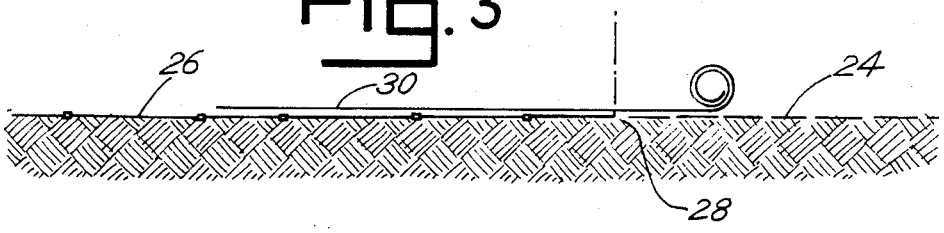
FIG. 3 is a schematic illustration of the first steps in the method of construction of the present invention which utilizes a basket as depicted in FIGS. 1 and 2.

As shown in FIG. 3, a generally planar earthen surface 24 or datum plane is established, for example, by means of a grader. This surface 24 is compacted and prepared for the erection of the constructional work of the invention. As a first step in the construction, soil reinforcing elements 26 are placed along the datum plane 24. The elements extend from a line 28 defining generally the front wall of the construction. The elements or grid members 26 may be any of a variety of materials and shapes. For example, they may be a wire fabric or a plastic fabric material. The grid members 26 may also be longitudinal ribbons of galvanized steel. The grid members 26 may also be a fabric. Vidal in his various patents previously referenced described numerous types of such elements 26.

The objective of the elements 26 is to at least partially interact by friction with the loose particulate material compacted against said elements 26. It is to be noted that such interaction does not necessarily need to be solely by friction, but it is at least partially by friction in order to provide for the soil reinforcement characteristics desired with respect to this construction.

Next, a flexible fabric such as fabric 30 is overlayed over at least a portion of the grid member or elements 26 adjacent to the line defining the front wall 28. The fabric 30 lies over the elements 26 and extends from wall line 28 for a dimension which exceeds the depth of the bottom wall 18 of the tray or basket 10. The fabric 30 also extends forward and ultimately upward along the wall line 28.

Figure 4:
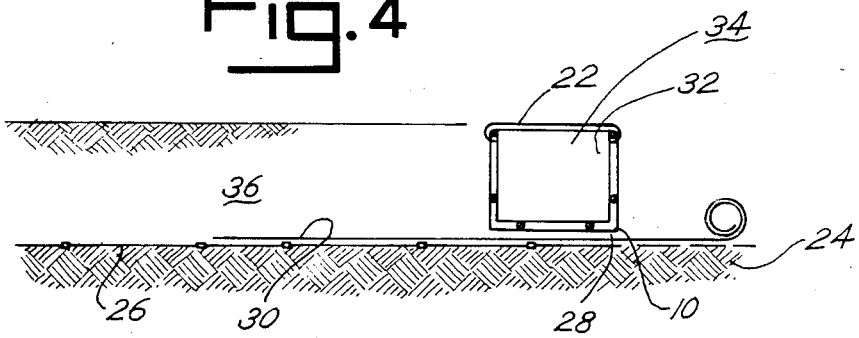
FIG. 4 is a schematic illustration of subsequent steps in the method of the invention following the steps shown in FIG. 3.

As observed by reference to FIG. 4, the preferred method requires that the front wall 16 of the basket 10 is fitted along the wall line 28. The basket 10 is also preferably lined with a fabric material 32 which is substantially identical to the fabric material 30. However, use and type of the fabric material 32 is optional.

Struts 22 may, at this stage in the making of the construction, be attached to the basket 10 in the manner previously described to connect the front and back walls 16 and 20. Subsequently, granular fill 34 is filled within the basket 10. Thereafter any of a number of steps may be implemented. As a first alternative the fabric 30 may be folded over the top of the basket 10 and backfill 36 then positioned over the grid 26, fabric 30 and against the back wall 20.

Figure 5:
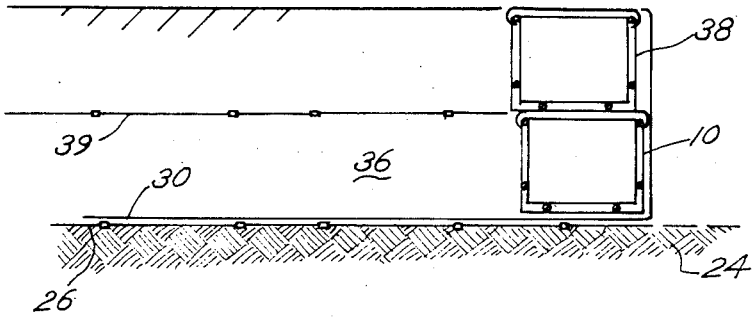
FIG. 5 is a schematic illustration of further construction steps following the steps of FIG. 4.

Alternatively, a second basket 38, such as illustrated in FIG. 5, may be positioned on top of the basket 10 and filled with granular material. Thereafter the flexible fabric 30 may be overlaid over both of the baskets 10 and 38. Backfill material 36 may then be added against both baskets 10 and 38. As another alternative, an additional reinforcing grid 39 can be positioned over the first basket 10 as illustrated in FIG. 5. To further enhance and provide for soil reinforcing features for the invention. The steps may be continuously repeated as depicted in FIGS. 3, 4 and 5 to thereby build an earthen construction of substantial height having a front wall defined by baskets 10, 38, etc., which are stacked one upon the other. In such circumstance the flexible fabric 30 fits over the front wall 16 of each basket 10. Each basket 10 may or may not include an inner lining of flexible fabric material 32. The granular material filled into the baskets 10 and 38 may be more course and is preferably somewhat more course than the backfill 36.

The flexible fabric 30 may be wrapped over one or more vertically stacked baskets. The depth dimension associated with the lowest basket 10 in FIG. 5 and, more particularly, the dimension separating the front wall 16 and back wall 20 may be varied from basket to basket depending upon constructional desires and calculations associated with the construction. For example, the dimension separating the walls 16 and 20 of lower basket 10 may be greater than that separating the walls of upper basket 38. Alternatively, the front and rear walls of ascending baskets may have a greater separation.

Figure 6:
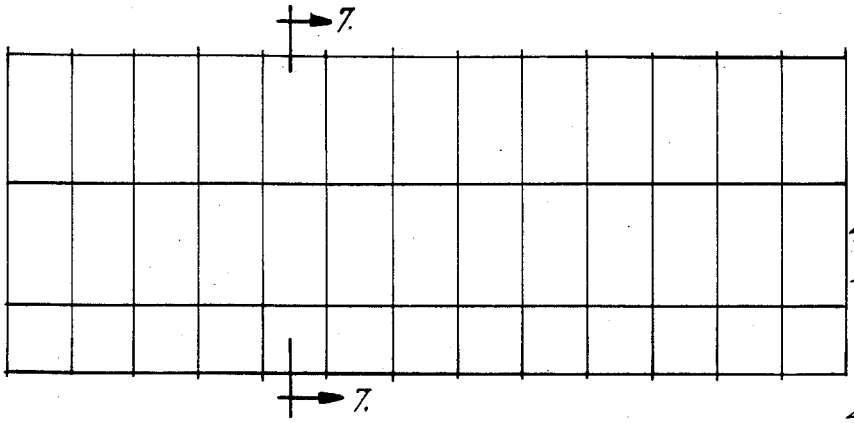
FIG. 6 is a front elevation of an alternative basket construction for a second embodiment of the invention.
Figure 7:
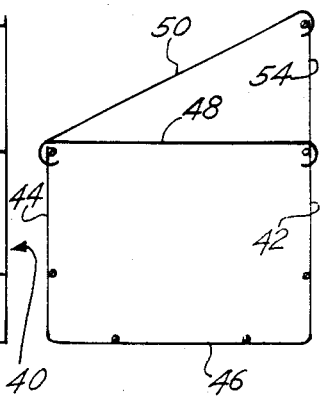
FIG. 7 a side cross sectional view taken along the line 7—7 in FIG. 6.

FIGS. 6 and 7 illustrate another variation with respect to a basket 40 which is utilized in the construction. As illustrated in FIGS. 6 and 7, basket 40 includes a front wall 42 having a vertical height or dimension greater than that of the back wall 44. The front wall 42 is separated from the back wall 44 by a bottom wall of 46. The dimension of the bottom wall 46 is greater than the height of the back wall 44 but less than the height of the front wall 42. Additionally, horizontal struts 48 as well as angle struts 50 may be utilized to connect the front wall 42 to the back wall 44. Note, however, that the general cross section or configuration of the basket 40 remains that of a U-shape. Note also that the width of the basket 40 in FIG. 6 remains generally significantly greater than the depth associated with the dimension of the bottom wall 46 in FIG. 7. Again all of the dimensions and materials of the basket 40 may be adjusted in accord with empirical or calculated desires.

Figure 8:
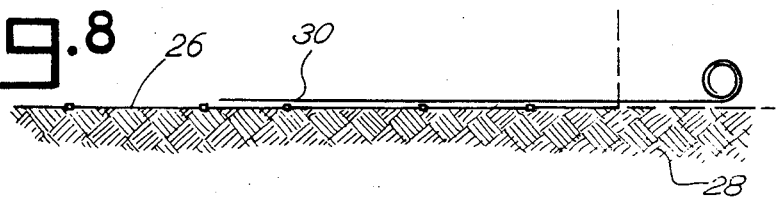
FIG. 8 is a schematic illustration of the first steps of the method of the invention utilizing the basket construction illustrated in FIGS. 6 and 7.
Figure 9:
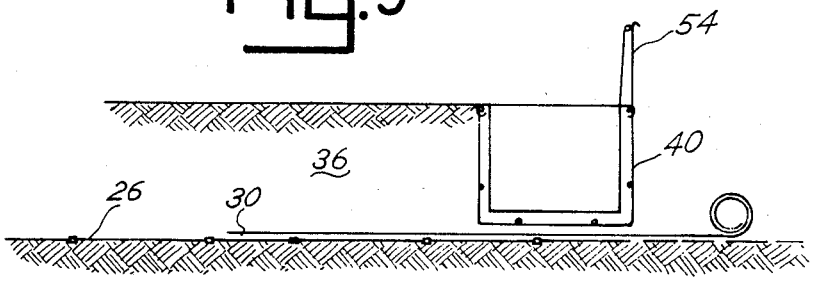
FIG. 9 is a schematic illustration of subsequent steps following the steps of FIG. 8.
Figure 10:
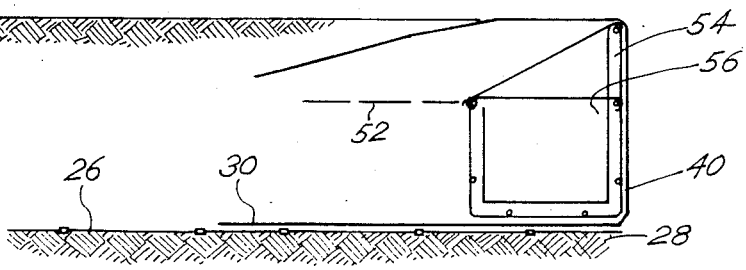
FIG. 10 is a schematic illustration of a series of additional steps in the method of the construction of the invention following the steps of FIG. 9.

Using a basket depicted in FIGS. 6 and 7 one may practice the method of the invention as illustrated by FIGS. 8 through 10. FIG. 8 illustrates initial steps substantially identical to those described with respect to FIG. 3. FIG. 4 illustrates steps again substantially identical to those illustrated in FIG. 4. Note, however, that the front wall 42 of the basket 40 extends above the level of back wall 44. It is thus possible to increase the level of backfill above the level of the back wall 44 as shown in FIG. 2 to provide a construction as illustrated in cross section in FIG. 10. Additionally, it is possible to insert additional reinforcing elements such as grid 52 in FIG. 10 at the height of the back wall 44.

The next layer of the construction using the method of FIGS. 8 through 10 can be effected by positioning a basket 40 on top of the layer of backfill as depicted in FIG. 10. Alternatively, an additional basket 40 can be positioned on the backfill level illustrated in FIG. 9. In such circumstance, the forward or upper section 54 of the wall 42 of the basket 40 would overlap in part, the next vertical adjacent basket 40 stacked thereon. If fabricated in this manner the wall face would not be strictly vertical but would be step wise recessed as each level is progressively built. Either construction is useful. It should be noted, however, that by stacking subsequent layers one upon the top of the other as shown in FIG. 10, it is possible to obtain a generally vertical wall face. Again, it is preferred that each basket 40 be lined with a flexible fabric such as fabric 56 before compacted particulate or granular material is placed in the basket 40.

It is possible to very many of the features of the construction described. Essential parts of the construction include (1) the generally rigid grid or array of tensile members which at least, in part, frictionally engage a compacted mass of particulate; (2) fabric material overlaying, at least partially, the tensile members; and (3) a U-shaped cross section basket or container for granular backfill positioned to define the front wall of the earthen structure or constructional work. These elements in combination with the granular backfill and other backfill material provide for the basic assemblage of the earthen wall construction utilizing, in part, principles initially developed by Vidal particularly with respect to the feature of frictional engagement of particulate with the various tensile elements extending both longitudinally and laterally with respect to the face of the wall structure.

The face of the wall construction is a further combination of specially shaped baskets, cooperative struts, flexible fabric and granular fill. Thus there has been set forth a preferred embodiment of the invention; however, it is to be understood the invention is to be limited only by the following claims and their equivalents since many component parts may be varied in size and shape without avoiding the essence of the invention.

What is claimed is:

1. An improved constructional work comprising in combination:

(a) a first soil reinforcing layer of tensile elements in a generally horizontal array on a compact of soil, said layer defining a line which establishes a front face for an earthen wall of particulate material;

(b) a flexible fabric overlaying at least a portion of the first layer of elements and extending vertically and continuously upward at the front face;

(c) a formed basket of a generally rigid lattice of tensile members, said basket having a front side, a back side and, a bottom connecting the front and back sides said backside being spaced from the front side, the front side being generally vertical and parallel to the back side, the front side being generally in the front face of the wall with the flexible fabric overlying the outside of the front wall of the basket;

(d) particulate material compacted in the basket; and (e) particulate backfill material over the reinforcing elements and against the back side of the basket; said fabric continuing to over lie the top of the basket and extending into the backfill material to thereby form a partial envelope about the basket, said grid co-acting with the backfill material at least partially by friction to thereby provide earth retaining means.

2. The construction of claim 1 wherein the basket further includes at least a partial inner lining of flexible fabric material.

3. The construction of claim 1 wherein the front wall of the basket has a vertical height equal to the vertical height of the back wall.

4. The construction of claim 1 wherein the front wall is spaced from the back wall a distance greater than the height of the back wall.

5. The construction of claim 1 wherein the front wall is spaced from the back wall a distance less than the height of the front wall.

6. The construction of claim 1 wherein the front wall is connected to the back wall by generally horizontal struts spaced vertically above the bottom wall.

7. The construction of claim 1 wherein the walls are formed from a continuous grid of rigid wire mesh.

8. The construction of claim 1 including a plurality of layers of horizontal tensile elements spaced vertically and a plurality of baskets stacked one on top of the other associated with the elements.

9. The construction of claim 1 including a basket having a front wall with a vertical dimension greater than the back wall vertical dimension.

10. The construction of claim 10 including generally horizontal struts attaching the front wall to the back wall.

11. The construction of claim 10 including struts attaching the top of the back wall to the top of the front wall.

12. The construction of claim 1 including a basket having a front wall with a vertical dimension greater than the vertical dimension of the back wall and including a second basket stacked on the first basket with the bottom of the second basket extending horizontally from the back wall to the front wall of the first basket.

13. The construction of claim 1 wherein the particulate material in the basket has a larger average granular size than that of the backfill.

14. The construction of claim 1 wherein the basket is comprised of a grid of generally rectilinear members attached to each other.

15. The construction of claim 1 where in the soil reinforcing grid is comprised of a rectilinear grid of connected rod members.

16. A method of construction of a soil reinforced constructional work comprising the steps of:

(a) forming a generally planar datum surface, (b) positioning a first soil reinforcing array of tensile elements on the datum surface extending generally from a line which defines an upwardly extending wall surface;

(c) overlaying the elements with a flexible fabric which extends over at least a part of the elements and then extends upwardly along the wall surface;

(d) positioning on the elements and flexible fabric, a basket having a front wall, a back wall, and a connecting bottom wall, the front wall being generally coincident with the wall surface and overlayed with the fabric;

(e) filling the basket with a particulate material;

(f) folding the flexible fabric over the basket; and;

(g) backfilling over the elements against the back wall of the basket.

17. The method of claim 16 including the additional step of positioning layers of elements, basket and fabric one on top of the other to define a continuous wall surface and constructional work comprise of more than one layer of elements.

18. The method of claim 17 where in the vertical dimension of the front wall of each basket exceeds the vertical dimension of each back wall, and wherein the bottom walls are maintained generally horizontal with the front walls overlapping.

19. The method of claim 16 including the additional step of connecting tensile struts between the front and back walls of the basket before filling the basket with the particulate material.

* * * * *